US005832609A

United States Patent [19]

Jansen

[11] Patent Number: 5,832,609

[45] Date of Patent: Nov. 10, 1998

[54] METHOD FOR PRODUCING A VARIABLE THICKNESS RIM FOR A VEHICLE WHEEL

[75] Inventor: Daniel F. Jansen, Saline, Mich.

[73] Assignee: Hayes Lemmerz International, Inc., Romulus, Mich.

[21] Appl. No.: 826,640

[22] Filed: Apr. 4, 1997

Related U.S. Application Data

[60] Provisional application No. 60/015,140, Apr. 5, 1996.

[51] Int. Cl. [6] ..... B21D 53/30

[52] U.S. Cl. ..... 29/894.351; 29/894.322; 29/894.35; 29/894.354; 301/95

[58] Field of Search ..... 29/894.35, 894.351, 29/894.352, 894.353, 894.354, 894.322, 894.323; 301/63.1, 95, 96, 97

[56] References Cited

U.S. PATENT DOCUMENTS

| | | |
|---|---|---|
| 3,129,496 | 4/1964 | Cox . |
| 3,347,302 | 10/1967 | Lemmerz . |
| 3,846,886 | 11/1974 | Schroder et al. . |
| 3,926,025 | 12/1975 | Schroder et al. . |
| 4,127,020 | 11/1978 | Bosch . |
| 4,127,022 | 11/1978 | Bosch . |
| 4,143,533 | 3/1979 | Bosch . |
| 4,185,370 | 1/1980 | Evans . |
| 4,962,587 | 10/1990 | Ashley, Jr. et al. . |

*Primary Examiner*—P. W. Echols
*Attorney, Agent, or Firm*—MacMillan, Sobanski & Todd, LLC

[57] ABSTRACT

An improved method for producing a wheel rim for use in a vehicle wheel. The method includes the steps of: (a) providing at least two individual flat sheets of material having different thicknesses; (b) securing the two flat sheets of material together by welding to form a rim blank; (c) forming the rim blank into a generally cylindrical hoop having a first discrete section defined by one of the two flat sheets of material and a second discrete section defined by the other one of the two flat sheets of material, the first discrete section of the hoop defining a first outer diameter, extending a first axial length, and including a substantially uniform first thickness throughout the entire first axial length thereof, the second discrete section of the hoop defining a second outer diameter, extending a second axial length, and including a substantially uniform second thickness throughout the second axial length thereof; (d) subjecting the hoop to a series of metal forming operations to produce a finished wheel rim having at least one tire bead seat retaining flange and at least one tire bead seat surface.

13 Claims, 6 Drawing Sheets

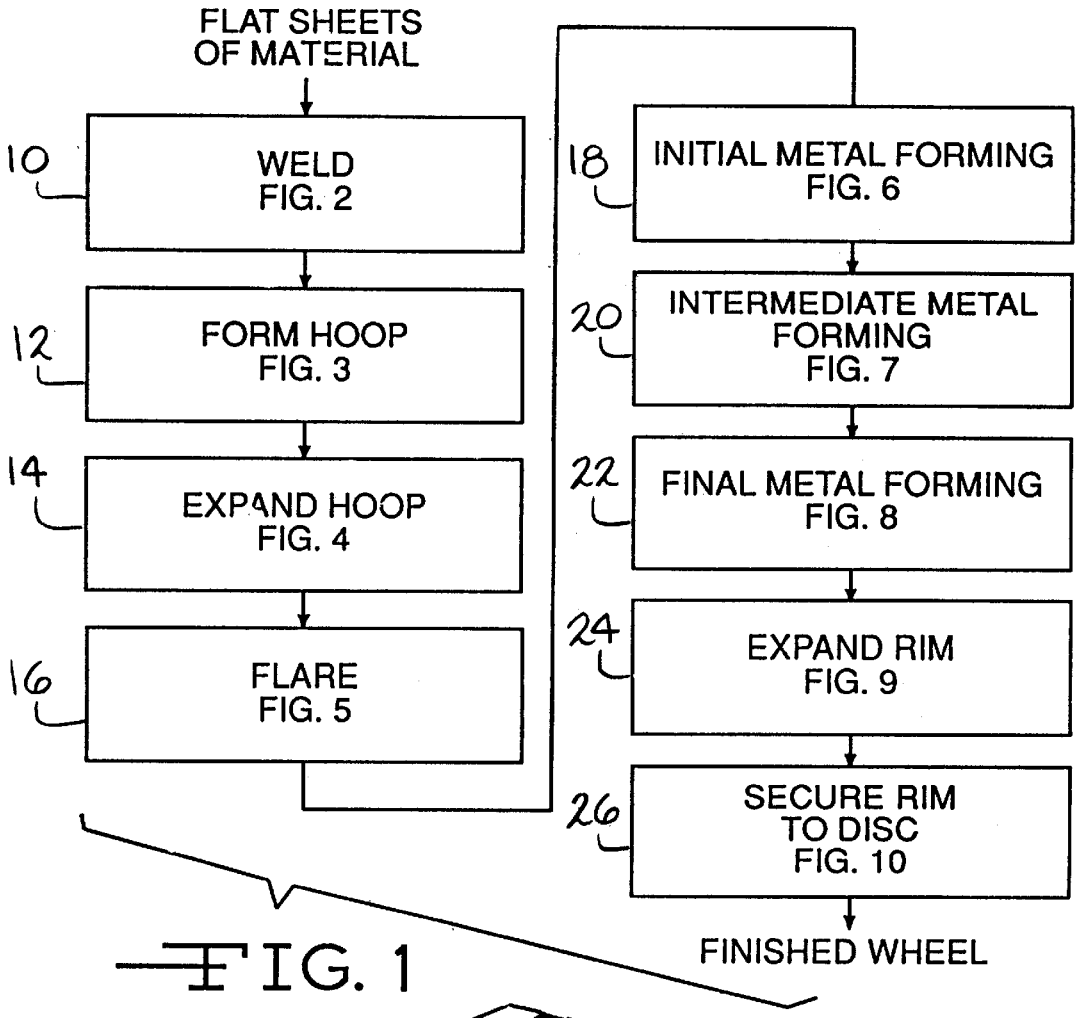
FIG. 1
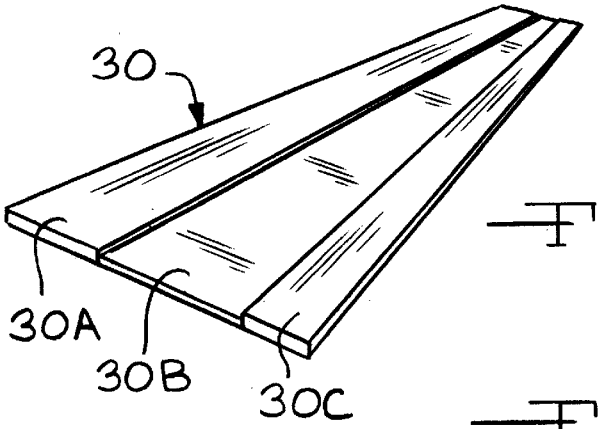
FIG. 2
FIG. 3
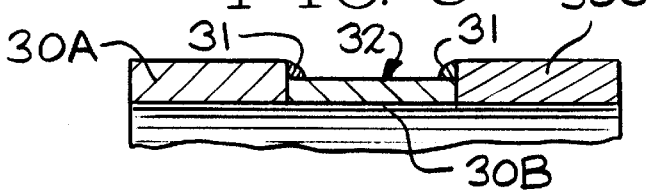

METHOD FOR PRODUCING A VARIABLE THICKNESS RIM FOR A VEHICLE WHEEL

CROSS-REFERENCE TO RELATED APPLICATIONS

This application claims the benefit of U.S. Provisional Application No. 60/015,140, filed Apr. 5, 1996.

BACKGROUND OF THE INVENTION

This invention relates in general to vehicle wheels and in particular to an improved method for producing a rim for use with such a vehicle wheel.

A typical sequence of steps which can be used to produce a wheel rim for a vehicle wheel is disclosed in U.S. Pat. No. 4,185,370 to Evans. As shown in this patent, the method includes the steps of: (a) providing a flat sheet of suitable material, such as steel or aluminum; (b) forming the sheet into a cylindrical hoop or band; (c) flaring the lateral edges of the hoop radially outwardly to produce a rim preform having flanges suitable for positioning on a roll forming machine: (d) subjecting the rim preform to a series of roll forming operations to produce a wheel rim having a predetermined shape; and (e) expanding the wheel rim to produce a finished wheel rim having a predetermined circumference.

As a result of forming the wheel rim in this manner, the roll forming operations produce a wheel rim having a generally uniform material thickness as the rim is progressively shaped. A slight thinning occurs only at those portions of the rim where the curvature changes and forms a radius. Thus, the generally uniform thickness of the rim results in the rim having extra material at places where it is not required for strength purposes. Since the weight of the wheel rim affects the performance of a vehicle, it is desirable to reduce the weight of the rim.

U.S. Pat. No. 3,129,496 to Cox discloses one method for reducing the weight of a wheel rim by thinning selected portions thereof. According to the method in this patent, a flat blank of material is provided having a uniform thickness and predetermined size. Next, the blank is formed into a cylindrical hoop by wrapping and welding abutting ends thereof. The hoop is positioned on a mandrel having a pressure yielding clamp for rotation therewith. One or more rollers are then actuated and advanced to engage the hoop thereby thinning and stretching the hoop to produce a wheel rim having varying thicknesses at predetermined areas therein.

Other methods for reducing the weight of a wheel rim by thinning selected portions of the rim by rolling or spinning operations are disclosed in U.S. Pat. No. 3,347,302 to Lemmerz, U.S. Pat. No. 4,127,022 to Bosch, U.S. Pat. No. 4,143,533 to Bosch, U.S. Pat. No. 4,962,587 to Ashley, Jr. et al.

SUMMARY OF THE INVENTION

This invention relates to an improved method for producing a variable thickness wheel rim for use in a vehicle wheel. The method includes the steps of: (a) providing at least two individual flat sheets of material having different thicknesses; (b) securing the two flat sheets of material together by welding to form a rim blank; (c) forming the rim blank into a generally cylindrical hoop having a first discrete section defined by one of the two flat sheets of material and a second discrete section defined by the other one of the two flat sheets of material, the first discrete section of the hoop defining a first outer diameter, extending a first axial length, and including a substantially uniform first thickness throughout the entire first axial length thereof, the second discrete section of the hoop defining a second outer diameter, extending a second axial length, and including a substantially uniform second thickness throughout the second axial length thereof, (d) subjecting the hoop to a series of metal forming operations to produce a finished variable thickness wheel rim having at least one tire bead seat retaining flange and at least one tire bead seat surface.

The use of at least two flat sheets of material having different thicknesses to produce the rim blank optimizes the use of the material in the finished variable thickness wheel rim.

Other advantages of this invention will become apparent to those skilled in the art from the following detailed description of the preferred embodiment, when read in light of the accompanying drawings.

BRIEF DESCRIPTION OF THE DRAWINGS

FIG. 1 is a block diagram showing a sequence of steps for producing a first embodiment of a variable thickness wheel rim for use in a vehicle wheel in accordance with this invention.

FIG. 2 is a schematic diagram of a first embodiment of a plurality of flat sheets of material welded together to form a rim blank.

FIG. 3 is a schematic diagram of the rim blank being formed into a hoop.

DETAILED DESCRIPTION OF THE PREFERRED EMBODIMENTS

Figure 10:
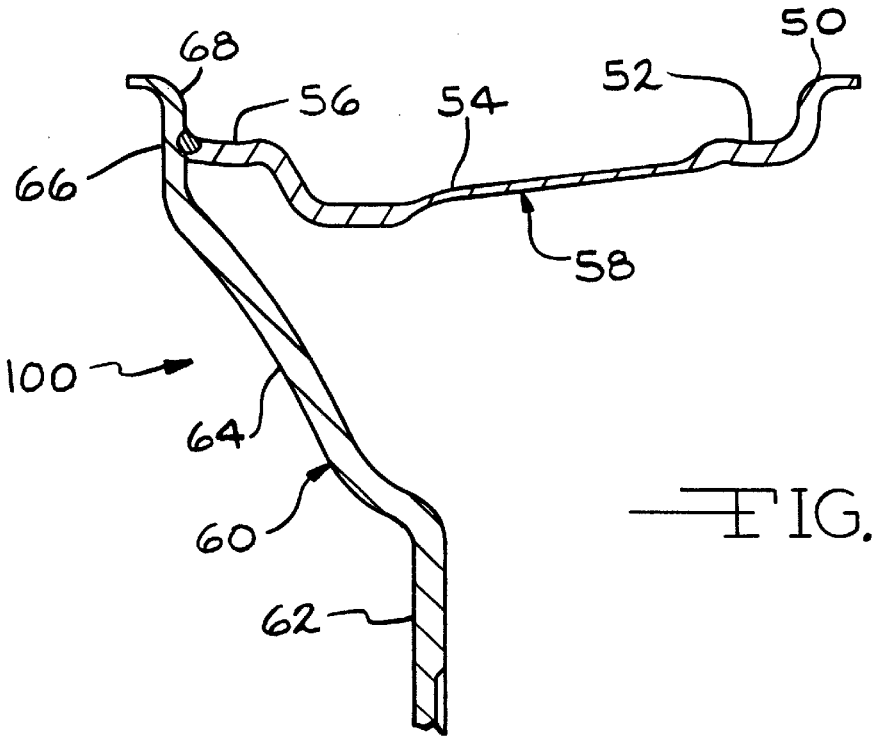
FIG. 10 is a partial sectional view of a finished full face fabricated vehicle wheel constructed using a wheel rim constructed in accordance with this invention.

Referring now to the drawings, there is illustrated in FIG. 1 a block diagram showing a sequence of steps for producing a vehicle wheel 100, such as shown in FIG. 10, and which incorporates a first embodiment of a variable thickness wheel rim, indicated generally at 58 and constructed in accordance with this invention. As shown in this embodiment, the vehicle wheel 100 is a full face fabricated wheel.

Figure 4:
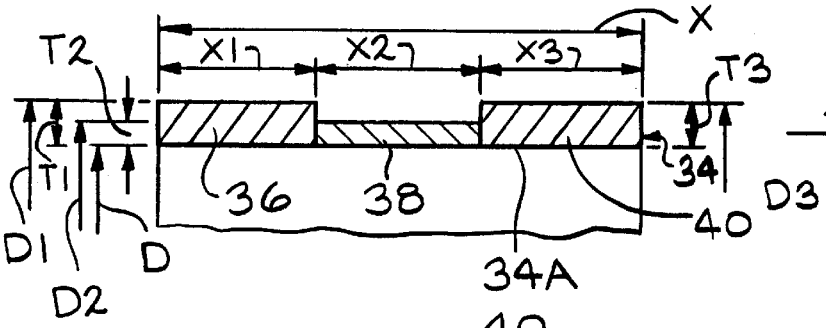
FIG. 4 is a schematic diagram of the hoop after an expanding operation.

Initially in step 10, a multiple number of flat sheets of suitable material, such as for example, steel, aluminum, alloys thereof, or a combination of two or more of these materials, are welded together (the welds only illustrated in FIG. 3 at 31), to form a rim blank 30 shown in FIG. 2. In this embodiment, the rim blank 30 includes three discrete flat sheets of material, 30A, 30B, and 30C each of the respective sheets having a predetermined thickness and axial length. Next, in step 12, the rim blank 30 is formed into a generally cylindrical hoop or band 32 and welded. When the hoop 32 is welded in step 12, a flat surface (not shown) is created by the weld. As a result of this, the hoop 32 is expanded in step 14 to produce a substantially cylindrical hoop 34 shown in FIG. 4.

The hoop 34 extends a predetermined axial length X and includes an inner surface 34A which defines an inner diameter D thereof. In the illustrated embodiment, the hoop 34 includes three distinct sections, namely a first section 36, a second section 38, and a third section 40. The first section 36 of the hoop 34 defines a first outer diameter D1, extends a first axial length X1, and includes a substantially uniform first thickness T1 throughout its axial length X1. The second section 38 of the hoop 34 defines a second outer diameter D2, extends a second axial length X2, and includes a substantially uniform second thickness T2 throughout its axial length X2. The third section 40 of the hoop 34 defines a third outer diameter D3, extends a third axial length X3, and includes a substantially uniform third thickness T3 throughout its axial length X3. In the illustrated embodiment, the first and third outer diameters D1 and D3 of the first section 36 and the third section 40, respectively, are generally equal to one another and greater than the second outer diameter D2 of the second section 38. The first axial length X1, the second axial length X2, and the third axial length X3 of the first section 36, second section 38, and the third section 40, respectively, are generally equal to one another. The first and third thicknesses T1 and T3 of the first section 36 and the third section 40, respectively, are generally equal to one another and greater than the second thickness T2 of the second section 38. Alternatively, the outer diameters D1, D2, and D3, the axial lengths X1, X2, and X3 and the thicknesses T1, T2, and T3 of the respective first section 36, second section 38, and third section 40 can be other than illustrated if desired.

Figure 5:
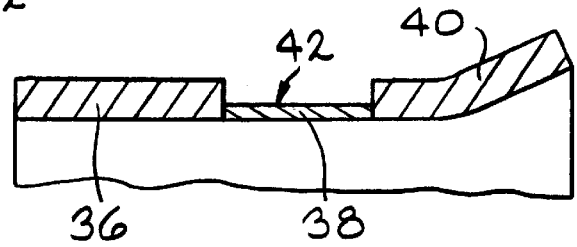
FIG. 5 is a schematic diagram of a wheel rim preform produced by a flaring operation.
Figure 6:
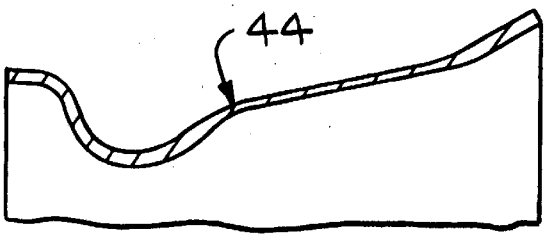
FIG. 6 is a schematic diagram of a partially-shaped wheel rim produced by an initial metal forming operation.
Figure 7:
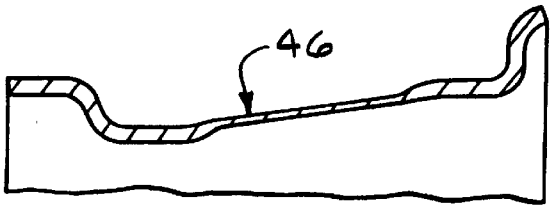
FIG. 7 is a schematic diagram of the partially-shaped wheel rim produced by an intermediate metal forming operation.
Figure 8:
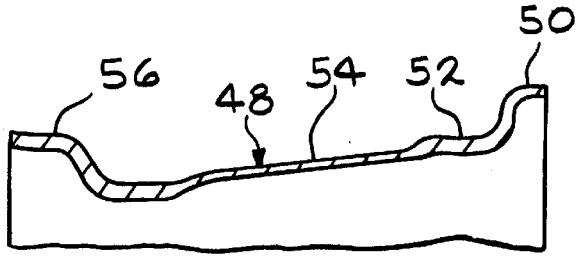
FIG. 8 is a schematic diagram of the partially-shaped wheel rim produced by a final metal forming operation.
Figure 9:
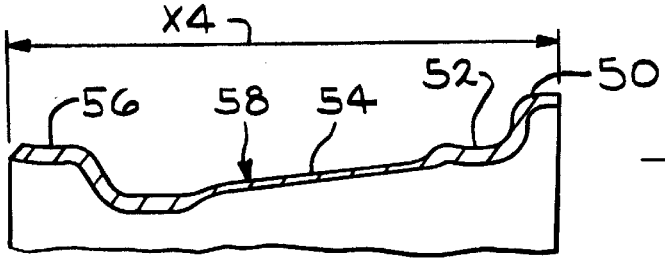
FIG. 9 is a schematic diagram of the finished wheel rim produced by an expanding operation.

Next, in step 16, the third section 40 of the hoop 34 is flared upwardly as to produce a wheel rim preform 42 shown in FIG. 5. Following this, in steps 18, 20, and 22, the wheel rim preform 42 is subjected to a series of metal forming operations, as shown in FIGS. 6, 7, and 8, to progressively produce variable thickness wheel rims 44, 46, and 48, respectively. Preferably, the metal forming operations of steps 18, 20, and 22 include subjecting the wheel rim preform 42 to a series of roll forming operations since tighter tolerances can be maintained in the wheel rim 48. Alternatively, other metal deforming operations can be used in one or more of the steps 18, 20, and 22 to progressively produce the wheel rim 48. For example, the wheel rim preform 42 can be subjected to forward or reverse flow spinning operations, pressing operations, or any suitable combinations of roll forming, flow spinning, and pressing operations which are operative to cause deformation, reshaping, and/or thinning of the metal to produce a variable thickness wheel rim having 48 having a desired profile.

The wheel rim 48 includes an inboard tire bead seat retaining flange 50, an inboard tire bead seat 52, a generally axially extending well 54, and an outboard tire bead seat 56. Next, in step 24, the wheel rim 48 is expanded to produce a finished variable thickness wheel rim 58. The finished variable thickness wheel rim 58 defines a finished wheel rim axial length X4. In the illustrated embodiment, the axial length X4 of the finished wheel rim 58 is greater than the axial length X of the hoop 34. Alternatively, the axial length of the hoop 34 and the axial length of the finished wheel rim 58 can be other than illustrated. For example, depending upon the particular structures of the rim blank 30 and the wheel rim 58, the axial length X4 of the finished wheel rim 58 can be equal to or less than the axial length X of the hoop 34.

In step 26, the wheel rim 58 is secured to a preformed full face wheel disc 60 by welding to produce the finished full face fabricated vehicle wheel 100. As shown in FIG. 10, the wheel disc 60 includes a central mounting surface 62, an intermediate bowl-shaped portion 64, and an outer portion 66 which defines an outboard tire bead seat retaining flange 68 of the wheel 100. The disc 60 can be formed from steel, aluminum, or alloys thereof depending upon the construction of the associated wheel rim 58.

Figure 11:
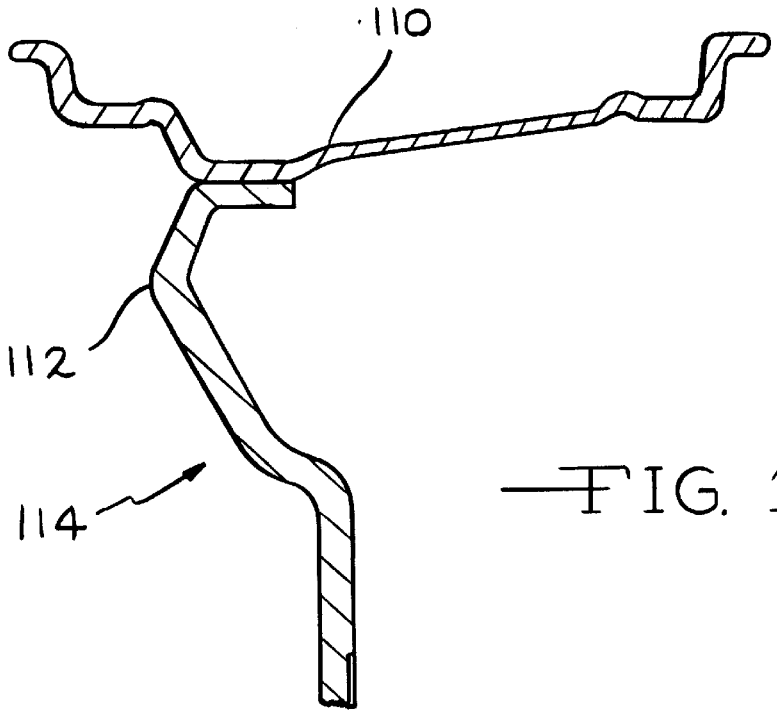
FIG. 11 is a partial sectional view of a finished conventional well-attached vehicle wheel constructed using an alternate embodiment of a variable thickness wheel rim constructed in accordance with this invention.
Figure 12:
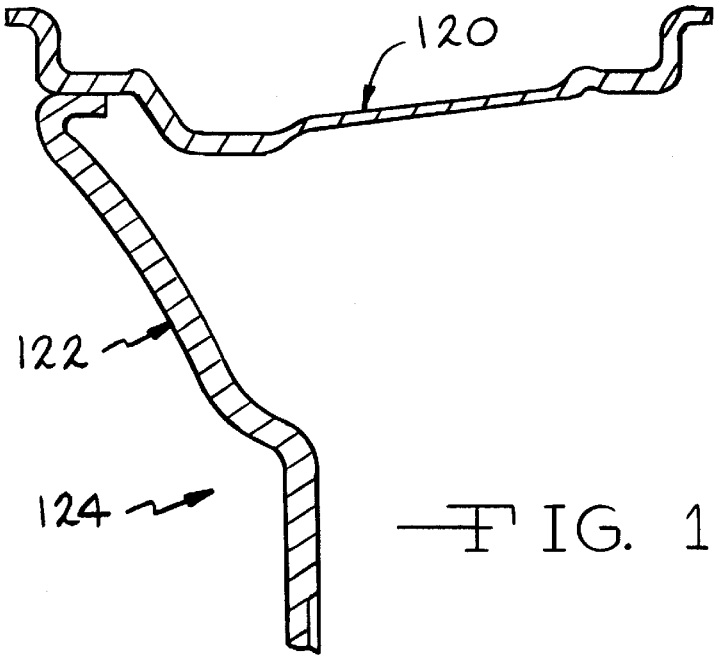
FIG. 12 is a partial sectional view of a finished conventional bead seat attached vehicle wheel constructed using another alternate embodiment of a variable thickness wheel rim constructed in accordance with this invention.
Figure 13:
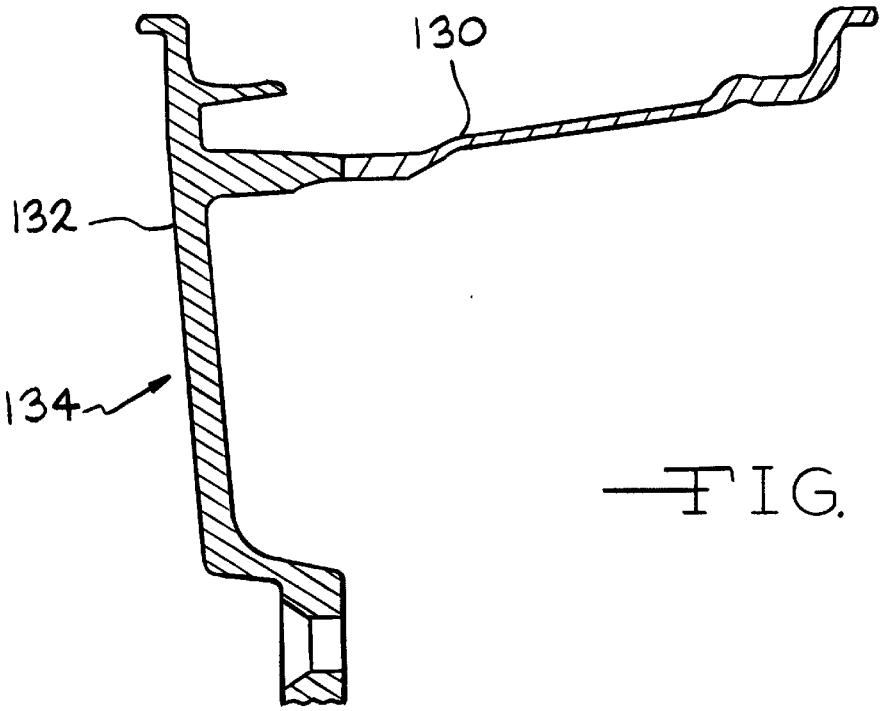
FIG. 13 is a partial sectional view of a finished full face modular vehicle wheel constructed using yet another alternative embodiment of a variable thickness wheel rim constructed in accordance with this invention.

While the invention has been illustrated and described as forming a variable thickness wheel rim 58 for use in a full face fabricated vehicle wheel 100, the invention can be practiced to form an associated variable thickness wheel rim for use in other types of wheels. For example, as shown in FIG. 11, the invention can be practiced to produce a variable thickness wheel rim 110, which is secured to a preformed wheel disc 112 to produce a well-attached fabricated vehicle wheel 114. Also, as shown in FIG. 12, the invention can be practiced to produce a variable thickness wheel rim 120, which is secured to a preformed wheel disc 122 to produce a bead seat attached fabricated vehicle wheel 124. In addition, as shown in FIG. 13, the invention can be practiced to produce a variable thickness partial wheel rim 130, which is secured to a cast full face wheel disc 132 to produce a full face modular vehicle wheel 134.

Figure 14:
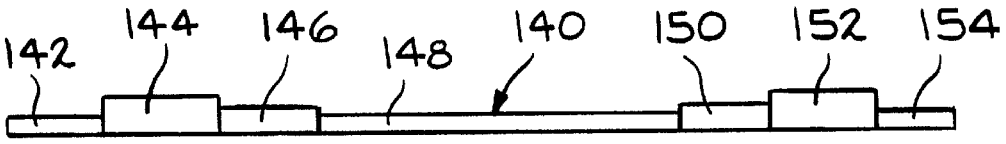
FIG. 14 is a schematic diagram showing a second embodiment of a rim blank for use in producing a variable thickness wheel rim in accordance with this invention to form a rim blank.
Figure 15:
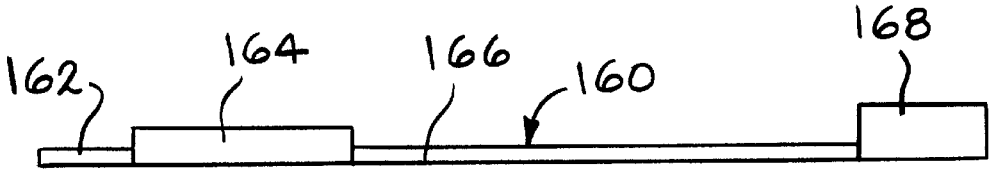
FIG. 15 is a schematic diagram showing a third embodiment of a rim blank for use in producing a variable thickness wheel rim in accordance with this invention to form a rim blank.
Figure 16:
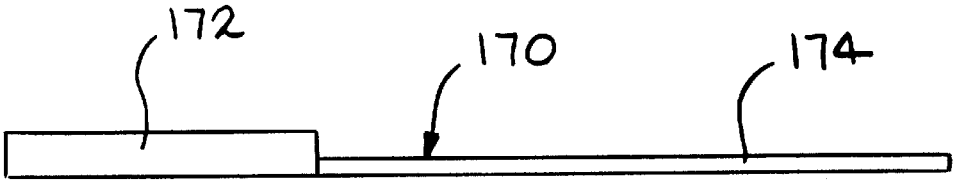
FIG. 16 is a schematic diagram showing a fourth embodiment of a rim blank for use in producing a variable thickness wheel rim in accordance with this invention.

Also, while the invention has been illustrated and described as forming a variable thickness wheel rim 58 from a rim blank 30 having three discrete flat sheets of material, 30A, 30B, and 30C, the invention can be practiced to form an associated variable thickness wheel rim from a rim blank having other arrangements and/or configurations of at least two flat sheets of material. For example, as shown in FIG. 14, a rim blank 140 having seven discrete flat sheets of material 142, 144, 146, 148, 150, 152, and 154 joined together can be provided to form an associated variable thickness wheel rim (not shown) in accordance with this invention. Also, as shown in FIG. 15, a rim blank 160 having four discrete flat sheets of material 162, 164, 166, and 168 joined together can be provided to form an associated variable thickness wheel rim (not shown) in accordance with this invention. In addition, as shown in FIG. 16, a rim blank 170 having two discrete flat sheets of material 172, and 174 joined together can be provided to form an associated variable thickness wheel rim (not shown) in accordance with this invention.

Figure 17:
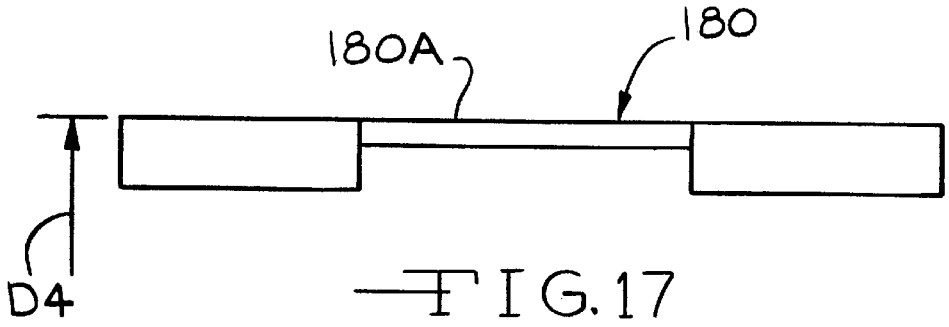
FIG. 17 is a schematic diagram showing a fifth embodiment of a rim blank for use in producing a variable thickness wheel rim in accordance with this invention.
Figure 18:
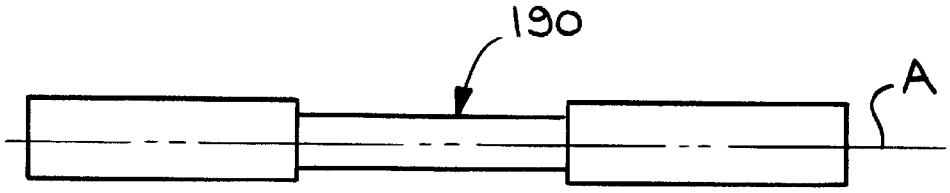
FIG. 18 is a schematic diagram showing a sixth embodiment of a rim blank for use in producing a variable thickness wheel rim in accordance with this invention.
Figure 19:
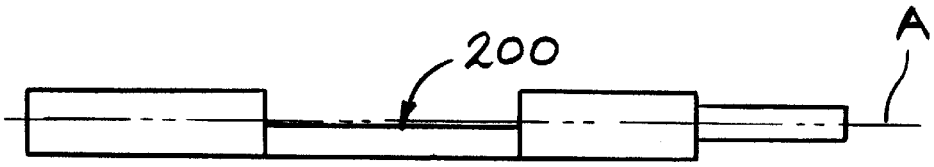
FIG. 19 is a schematic diagram showing a seventh embodiment of a rim blank for use in producing a variable thickness wheel rim in accordance with this invention.
Figure 20:
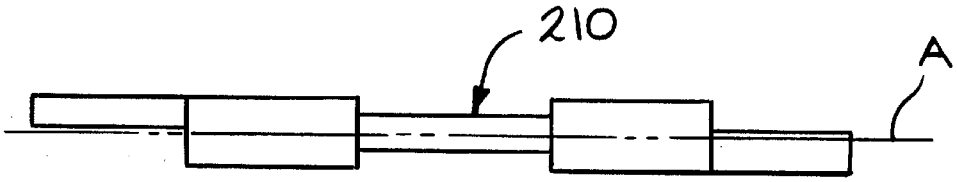
FIG. 20 is a schematic diagram showing an eight embodiment of a rim blank for use in producing a variable thickness wheel rim in accordance with this invention.

Also, as shown in FIG. 17, a rim blank 180 including a plurality of flat sheets of material joined together can be provided. The rim blank 180 is similar to the rim blank 30 shown in FIG. 2, except that the rim blank 180 is inverted relative to the structure of the rim blank 30. Thus, the rim blank 180 includes a common outer surface 180A which defines a common outer diameter D4 thereof. In addition, as shown in FIG. 18, a rim blank 190 including a plurality of flat sheets of material joined together can be provided. The rim blank 190 is similar to the rim blanks 30 and 170 shown in respective FIGS. 2 and 17, except that the flat sheets of material of the rim blank 190 are oriented along a common axis A of the rim blank 190. Also, as shown in FIG. 19, a rim blank 200 including a plurality of flat sheets of material can be provided. The rim blank 200 is a combination of a portion of the rim blank 30 shown in FIG. 2 and a portion of the rim blank 190 shown in FIG. 18. Further, as shown in FIG. 20, a rim blank 210 including a plurality of flat sheets of material joined together can be provided. The rim blank 210 is a combination of a portion of the rim blank 180 shown in FIG. 17, a portion of the rim blank 190 shown in FIG. 18, and a portion of the rim blank 30 shown in FIG. 2. The important feature of this invention is that a predetermined number of individual flat sheets of material having predetermined thicknesses and axial lengths can be utilized to form a desired rim blank which optimizes the use of the materials to produce the variable thickness wheel rim of this invention.

In accordance with the provisions of the patents statues, the principle and mode of operation of this invention have been described and illustrated in its preferred embodiments. However, it must be understood that the invention may be practiced otherwise than as specifically explained and illustrated without departing from the scope or spirit of the attached claims.

What is claimed is:

1. A method for producing a variable thickness rim for a vehicle wheel comprising the steps of:

(a) providing at least two individual flat sheets of material having different thicknesses;

(b) securing the two flat sheets of material together by welding to form a rim blank;

(c) forming the rim blank into a generally cylindrical hoop having a first discrete section defined by one of the two flat sheets of material and a second discrete section defined by the other one of the two flat sheets of material, the first discrete section of the hoop defining a first outer diameter, extending a first axial length, and including a substantially uniform first thickness throughout the entire first axial length thereof, the second discrete section of the hoop defining a second outer diameter, extending a second axial length, and including a substantially uniform second thickness throughout the second axial length thereof; and (d) subjecting the hoop to a series of metal forming operations to produce a finished variable thickness wheel rim having at least one tire bead seat retaining flange and at least one tire bead seat surface.

2. The method according to claim 1 and further including expanding the hoop to a predetermined inner diameter prior to performing step (d).

3. The method according to claim 1 and further including flaring at least one axial end of the hoop prior to performing the metal forming operations of step (d).

4. The method according to claim 3 wherein both axial ends of the hoop are flared and the finished variable thickness wheel rim includes a pair of opposed tire bead seat retaining flanges, a generally axially extending well, and a pair of opposed tire bead seat surfaces.

5. The method according to claim 4 and including securing the finished variable thickness wheel rim of step (d) to a preformed wheel disc to produce a well-attached fabricated vehicle wheel.

6. The method according to claim 4 and including securing the finished variable thickness wheel rim to a preformed wheel disc to produce a bead seat attached fabricated vehicle wheel.

7. The method according to claim 1 and including securing the finished variable thickness wheel rim of step (d) to a preformed wheel disc to produce a full face fabricated vehicle wheel.

8. The method according to claim 1 and including securing the finished variable thickness wheel rim of step (d) to a preformed wheel disc to produce a full face modular vehicle wheel.

9. The method according to claim 1 wherein step (d) includes subjecting the hoop to a series of roll forming operations.

10. The method according to claim 1 wherein step (d) includes subjecting the hoop to a series of flow spinning operations.

11. The method according to claim 1 wherein step (d) includes subjecting the hoop to a series of flow spinning and roll forming operations.

12. The method according to claim 1 wherein the flat sheets of material are formed from the same material.

13. The method according to claim 1 wherein the flat sheets of material are formed from different materials.

* * * * *